United States Patent [19]

Olson

[11] Patent Number: 4,792,102

[45] Date of Patent: Dec. 20, 1988

[54] PAPER TOWEL DISPENSER

[76] Inventor: Douglas M. Olson, 1980 Galena St., Aurora, Colo. 80010

[21] Appl. No.: 134,880

[22] Filed: Dec. 18, 1987

[51] Int. Cl.[4] ..... B65H 19/00

[52] U.S. Cl. ..... 242/55.54

[58] Field of Search ..... 242/55.2, 55.42, 55.54; 225/51, 47, 79; D6/521

[56] References Cited

U.S. PATENT DOCUMENTS

| | | | |
|---|---|---|---|
| 3,539,124 | 11/1970 | Belokin | 242/55.54 |
| 3,941,325 | 3/1976 | Krause | 242/55.54 |
| 4,030,676 | 6/1977 | Bardsley | 242/55.54 |
| 4,369,929 | 1/1983 | Cayer | 242/55.54 |
| 4,487,376 | 12/1984 | Compton | 242/55.54 |
| 4,720,053 | 1/1988 | Vance | 242/55.54 |

FOREIGN PATENT DOCUMENTS

| | | | |
|---|---|---|---|
| 285769 | 2/1928 | United Kingdom | 242/55.54 |

*Primary Examiner*—David Werner
*Attorney, Agent, or Firm*—Brian D. Smith

[57] ABSTRACT

An apparatus for dispensing a roll of paper towels and the like is disclosed. The apparatus includes a base and an upright rod attached thereto for maintaining a roll installed thereon in an upright position. The roll is installed on the rod with the rod positioned within the hollow interior of the roll. The apparatus also includes a brake support structure attached to the base which is spaced from the rod to permit a roll of paper towels to be installed on the rod. The apparatus further includes brake means having releasable attaching means and movable attaching means. The releasable attaching means attaches the brake means to the rod to secure the brake means in a braking position. The movable attaching means movably attaches the brake means to the brake support structure. Together, the movable and releasable attaching means enable the brake means to be released and moved away from the rod. The brake means also defines an underside surface which frictionally engages an end of the roll when the brake means is in the braking position. The frictional engagement stops the roll from rotating and unrolling after a paper towel has been torn from the roll.

17 Claims, 2 Drawing Sheets

FIG 4
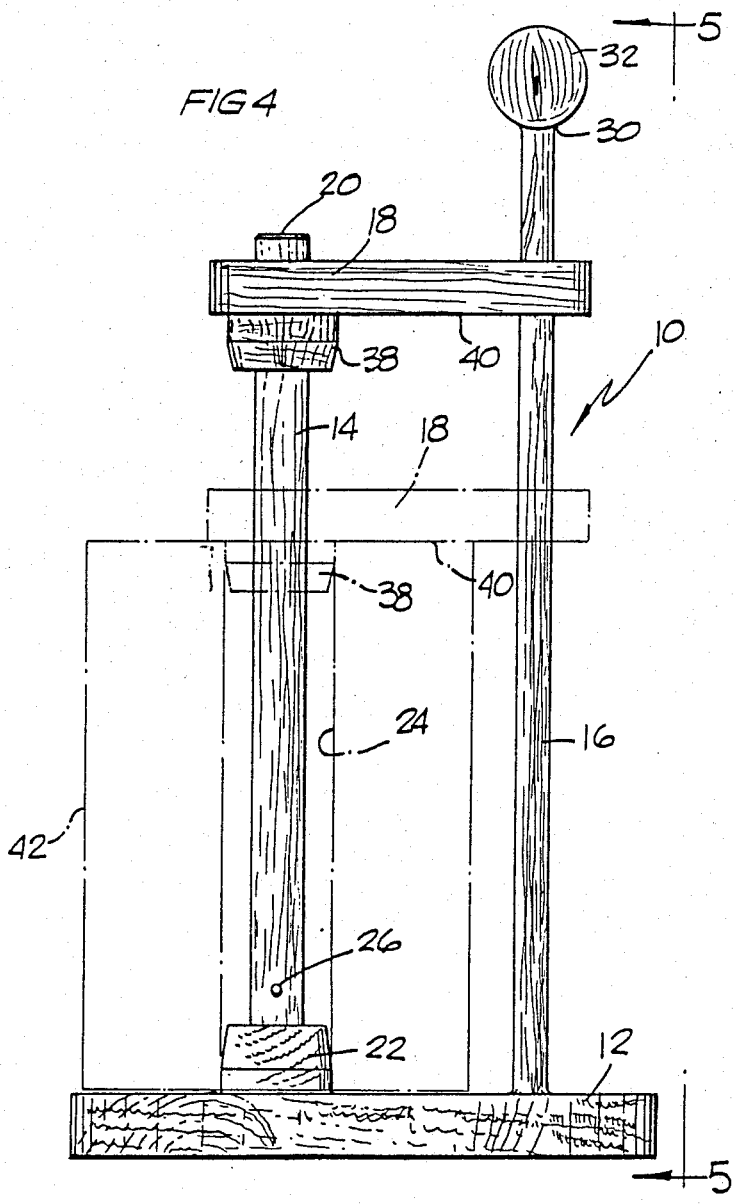
FIG. 5.
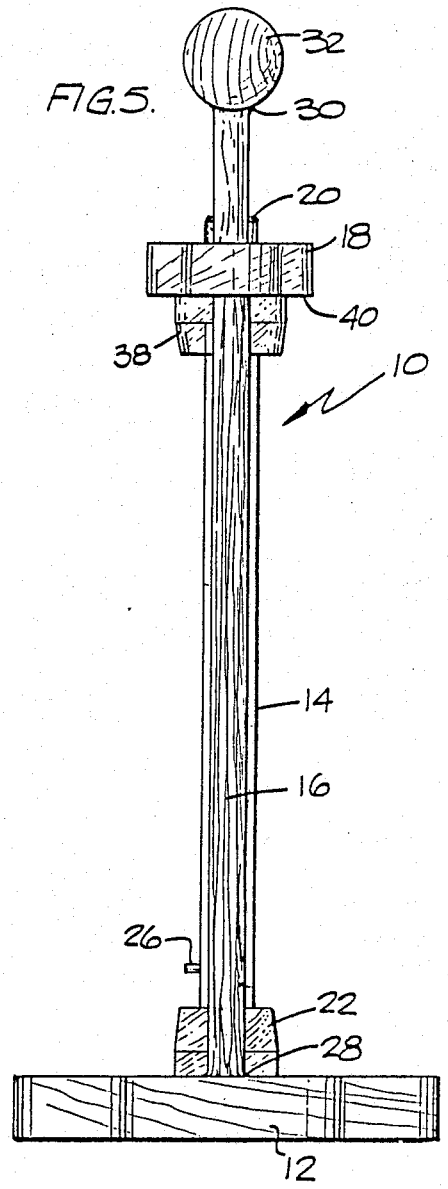
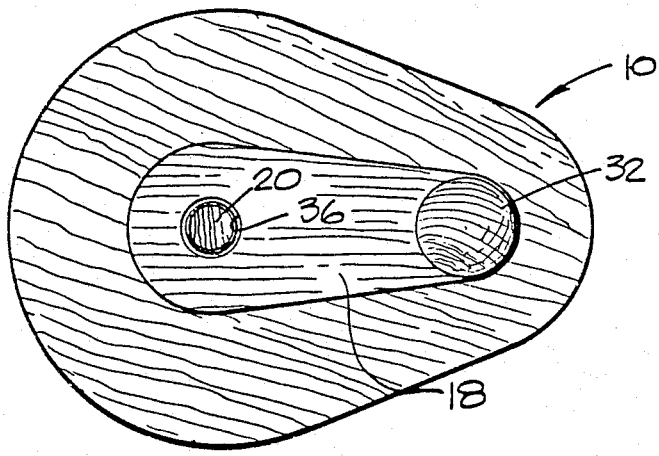
FIG. 6

PAPER TOWEL DISPENSER

TECHNICAL FIELD

The invention relates generally to apparatus for dispensing a roll of paper and, more particularly, to apparatus for dispensing paper towels vertically rather than horizontally.

BACKGROUND OF THE INVENTION

The prior art is replete with apparatus for horizontally dispensing rolls of paper towels and the like. Such dispensers work fine in many situations. There are, however, many situations were it would be desirable to have a dispenser which is capable of dispensing paper towels in a vertical or upright fashion. For instance, space limitations can sometimes make it difficult to install a horizontal dispenser. Moreover, even if a horizontal dispenser can be easily installed, there are many situations where a vertically oriented dispenser would blend in better with the decor of the room in which the dispenser is to be installed. Horizontal dispensers are also generally not very portable.

Accordingly, an object of the present invention to provide an apparatus for dispensing a roll of paper towels and the like vertically.

Another object of the present invention is to provide a vertically dispensing paper towel apparatus which is portable, easy to use and generally inexpensive to manufacture.

Yet another object of the present invention is to provide a vertically dispensing paper towel apparatus which easily accommodates differently sized rolls of paper towels, including rolls having different lengths or heights.

Yet a further object of the present invention is to provide a vertically dispensing paper towel apparatus that stops a roll of paper towels from rotating and unrolling after a paper towel has been torn from the roll.

These and other objects will become apparent from the drawings, specifications and claims appended hereto.

SUMMARY OF THE INVENTION

In accordance with these objects, the present invention provides an apparatus for vertically dispensing a roll of paper towels and the like. In its broad sense, the apparatus includes a base, a first upright rod-like member attached to the base and a second upright rod-like member or brake support structure also attached to the base but which is spaced from the first rod-like member to permit a roll of paper towels to be installed on the first rod-like member. In addition, the apparatus includes a gravity brake means having releasable and moveable attaching means for attaching the brake means to the first and second rod-like members to secure the brake means in a braking position. The releasable attaching means is also capable of releasing the brake means from attachment to the first rod-like member. The movable attaching means movably attaches the brake means to the brake support structure so that the moveable and releasable attaching means can cooperate to release and move the brake means away from the first rod-like member. This enables a roll installed on the dispenser to be removed from the first rod-like member and replaced with a new roll. The brake means also defines an underside surface for frictionally engaging the upwardly facing end of a roll installed on the dispenser, when the brake means is in the braking position. This stops the roll from rotating and unrolling after a paper towel has been torn from the roll.

In a preferred embodiment, the releasable attaching means includes a first bore provided in the brake means for slidably receiving the first rod-like member to secure the braking means in the braking position. The movable attaching means includes a second bore for slidably and rotatably engaging the second rod-like member to enable the brake means to be slidably moved along the second rod-like member and rotated thereabout so that the roll may be removed from the first rod-like member and replaced with a new roll.

The present invention also preferably includes a lower centering bearing rotatably mounted about the first rod-like member against the base. The bearing is sized and configured to center a roll on the first rodlike member and is rotatable thereabout to reduce drag on the roll when it is desired to tear off a paper towel from the roll. The invention also preferably includes an upper centering collar having a center bore for slidably receiving the first rod-like member. The upper collar is rigidly attached to the underside of the brake means and axially aligned with the first bore of the brake means. The upper collar is also sized and configured to project into the upwardly facing end of the hollow interior of a roll to center the roll about the first rod-like member.

The present invention may also include weights affixed to the brake means for increasing frictional engagement between the brake means and a roll installed on the dispenser.

BRIEF DESCRIPTION OF THE DRAWINGS

In the description below, reference in made to the following drawings in which:

FIG. 1 is a perspective view of an apparatus of the present invention for vertically dispensing a roll of paper towels and the like.

FIG. 4 is a side view of the apparatus illustrated in FIG. 1 which in phantom illustrates the brake means engaging a short roll of paper towels.

FIG. 5 is an end view of the apparatus taken along lines 5—5 of FIG. 4.

FIG. 6 is a top plan view of the apparatus of FIG. 1.

BEST MODE FOR CARRYING OUT THE INVENTION

Figure 1:
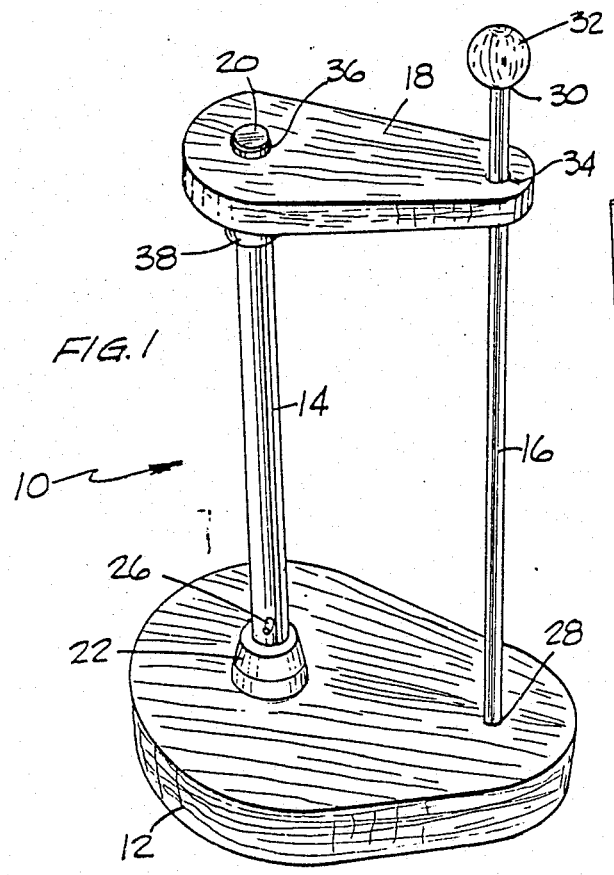

FIGS. 1 through 6 illustrate a dispenser or apparatus 10 for vertically dispensing a roll 11 of paper towels and the like. Dispenser 10 generally includes a base 12, first and second upright rod-like member or rods 14 and 16, respectively, and a gravity brake or clutch means 18.

First rod 14 is generally cylindrically and provided with a distal end 20 and a proximate end (not numbered). The proximal end is attached to base 12 by any suitable means so that rod 14 projects outwardly therefrom at a right angle. As such, when base 12 is mounted or placed on a horizontal surface, rod 14 will be in an upright or vertically oriented position.

It can also be seen in the Figures, that the proximal end of rod 14 has a rotatable bearing or lower centering collar 22 mounted about it. Bearing 22 is sized and configured to accommodate or engage the inner wall (identified by numeral 24 in FIG. 2) defining the hollow interior of most commercially available rolls of paper towels. By engaging the bearing, drag on the roll is reduced when it is desired to tear a paper towel from the roll.

Figure 2:
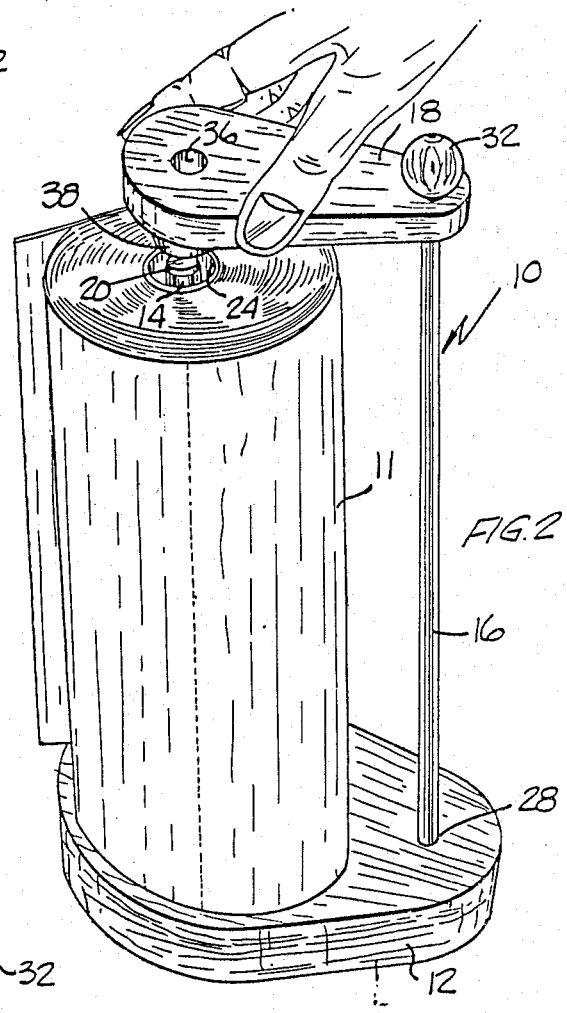
FIG. 2 is a perspective view of the apparatus of FIG. 1 additionally showing a roll of paper towels installed on the apparatus and an individual's hand aligning the brake means of the present invention prior to positioning it up against the end of the roll.
Figure 3:
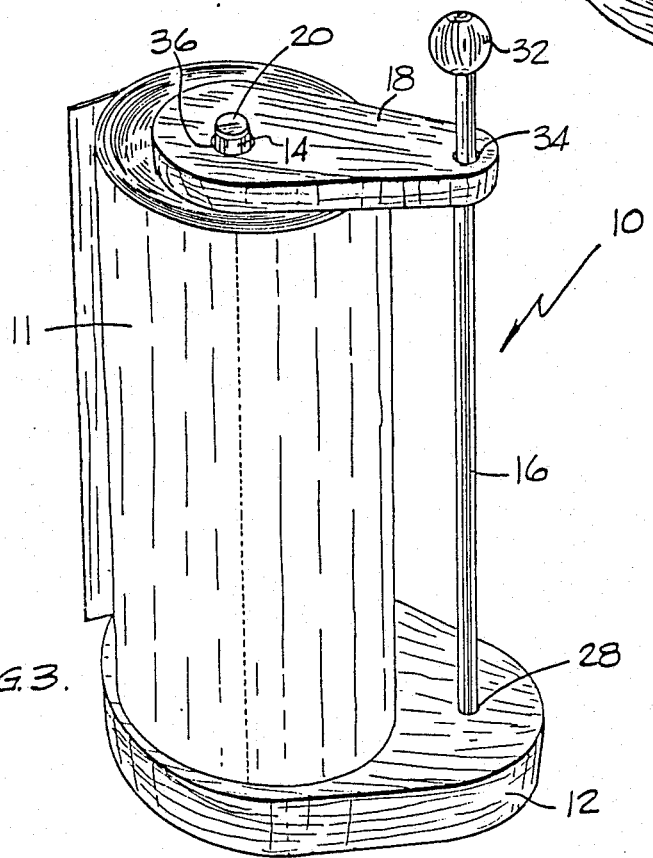
FIG. 3 is another perspective view of the apparatus of FIG. 1 showing the brake means positioned up against the end of the roll in its braking position.

Rod 14 is also provided with a stop means or pin 26 which projects outwardly from rod 14 a distance which is sufficient, as illustrated in FIG. 2, to prevent bearing 22 from sliding upwardly. As such, the bearing is prevented from becoming lost which might happen if it were to stick to the end of a roll being removed from dispenser 10 for whatever reason. As also illustrated in FIG. 2, pin 26 only projects outwardly from rod 14 a slight distance so as to not contact wall 24 of the roll. Pin 26 may be attached to rod 14 by any suitable means such as by glue.

Rod 16 (also sometimes more generically referred to as brake support structure) is, as illustrated, preferably cylindrical and taller than rod 14. Rod 16 is also provided with a proximal end 28 and a distal end 30. Proximal end 28 is preferably rigidly attached to base 12 by any suitable means so that, as with first rod-like member 14, it extends outwardly from base 12 at a right angle, thereby being in an upright or vertically oriented position when base 12 is mounted or placed on a horizontal surface.

Distal end 30 of rod 16 has a cap or knob 32 rigidly attached to it which prevents brake means 18 from sliding off distal end 30. Cap 32 may be rigidly attached to distal end 30 by any suitable means such as; for example, by gluing and/or threading it to end 30. Cap 32 enhances the dispenser's portability by providing a means for holding or grabbing the dispenser so that it can be carried to wherever it is needed.

Brake means 18 is slidably and rotatably attached to rod 16 by cylindrical bore 34 which extends through an end of brake means 18. The inside diameter bore 34 is slightly larger than the outside diameter of rod 16 so that the brake means can be easily slid up and down rod 16 and also rotated thereabout.

Brake means 18 is also provided with another cylindrical bore 36 which is spaced from bore 34 so that it is capable of axially aligning with the lengthwise or cylindrical axis of rod 14. As with bore 34, bore 36 also has an inside diameter which is slightly larger than the outside diameter of rod 14. As such, bore 36 is capable of easily slidably engaging or receiving rod 14 as such is depicted in the Figures.

Brake means 18 is also provided with an upper centering collar 38 which is rigidly attached to an underside surface 40 of brake means 18. Collar 38 also defines a cylindrical bore (not numbered) which is the same size as bore 36 and axially aligned therewith so that brake means 18 and collar 38 can slidably engage rod 14 as a unit and thereby slide up and down both rods 14 and 16, respectively, as is needed to engage rolls of paper towels having different heights. For example, in FIG. 4, it can be seen, in phantom, that brake means 18 and attached collar 38 have been slid downwardly on rods 14 and 16, respectively, until the brake means underside surface 40 is in contact with the upwardly facing end of a roll 42 of paper towels which is much shorter than roll 11.

To enable underside surface 40 of brake means 18 to contact and engage the end of a roll, collar 38 is also sized and configured so that it is capable of projecting into the upwardly facing end of the hollow interior defined by the roll. Collar 38 is also provided with an outside diameter which is similar to that of lower bearing 22 so that the collar and bearing center the roll about the axis of rod 14.

An important aspect of the present invention is directed to preventing a roll of paper towels from continuing to unroll after a paper towel has been torn from the roll. Unrolling of the roll, sometimes complete unrolling of the roll, sometimes results when an individual quickly tears or rips a paper towel from the roll. The quick tearing or ripping action often causes the roll to rapidly rotate which, in turn, causes the roll to rapidly unroll, thereby usually wasting or using more paper towels than is necessary to clean up a particular job.

The force of gravity which acts upon brake means 18 solves the unrolling problem by causing underside surface 40 to frictionally engage the upwardly facing end of the roll. As such, rotation of even a rapidly rotating and unrolling roll will be quickly halted, thereby preventing the roll from completely unrolling or unrolling to any significant extent. Moreover, by increasing the weight of brake means 18 (e.g., by adding weights to it) and/or by roughening underside surface 40, frictional engagement with the end of the roll can be increased, thereby even more quickly halting rotation and unrolling the roll.

To install a roll of paper towels on dispenser 10 of the present invention, one first slides brake means 18 upwardly to lift it off distal end 20 of first rod 14. Brake means 18 is then rotated away from first rod 14 about second rod 16. A roll such as roll 11 or roll 42 is then installed on first rod 14 with rod 14 positioned within the roll's hollow interior. When installed, lower bearing 22 should project into the downwardly facing end of the roll's hollow interior as such is depicted in the Figures. Brake means 18 is then moved to its braking position (which prevents the roll from unrolling as previously described) by rotating it so that upper collar 38 is axially aligned with the axis of rod 14 as depicted in FIG. 2 and by sliding it downwardly onto rod 14 until collar 38 is completely inserted into the upwardly facing end of the roll's hollow interior. As such, underside surface 40 will be in contact with and frictionally engaging the upwardly facing end of the roll.

To tear a paper towel from a roll installed on dispenser 10, one merely unrolls the desired amount of paper from the roll and tears it off. Any rapid rotation or unrolling of the roll caused by quickly tearing and/or ripping of the paper from the roll will be quickly halted by the dispenser's brake means 18.

From the foregoing description, a number of significant advantages of the present invention should be readily apparent. The invention enables paper towels to be dispensed vertically as opposed to horizontally. Accordingly, the invention can be used in many places where it is not feasible to use horizontal dispensers. The invention is also portable in the sense that it can be transported and used wherever desired. This makes the invention more versatile than horizontal dispensers which generally have to be installed or mounted to a fixed object before they can be used. In addition, and unlike many paper towel dispensers, the dispenser of the present invention easily accommodates rolls of many different sizes and heights. Moreover, the dispenser of the present invention provides a unique roll braking means utilizing gravity which prevents a roll of paper towels from unrolling to any significant extent after a paper towel has been torn from the roll.

This invention has been described in detail with reference to particular embodiments thereof, but it will be understood that various other modifications can be effected within the spirit and scope of this invention.

I claim:

1. An apparatus for vertically dispensing a roll of paper towels and the like, the roll defining a hollow interior which is axially aligned about an axis of the roll, the roll also having two ends, one of which faces upwardly and one of which faces downwardly when the roll is installed on said apparatus, said apparatus comprising:

a base;

a first upright rod-like member for maintaining a roll installed thereon in an upright position, said first rod-like member having a proximal end and a distal end with said proximal end attached to said base, the roll being installed on said first rod-like member so that said first rod-like member is positioned within the hollow interior of the roll;

a brake support structure having a proximal end and a distal end with said proximal end attached to said base, said brake support structure being spaced from said rod-like member to permit the roll of paper towels to be installed on said rod-like member; and gravity brake means defining an underside surface for frictionally engaging the upwardly facing end of the roll to stop the roll from rotating and unrolling after a paper towel has been torn from the roll, said gravity brake means also having movable attaching means for attaching said brake means to said brake support structure and for permitting movement of said brake means along said brake support structure so that said underside surface of said brake means is capable of frictionally engaging the upwardly facing end of rolls having different heights wherein roll height is measured between the ends of the roll.

2. An apparatus as claimed in claim 1 wherein said brake means includes a first bore for slidably receiving said first rod-like member to secure said braking means against the upwardly facing surface of the roll.

3. An apparatus as claimed in claim 1 wherein said movable attaching means includes a second bore for slidably and rotatably engaging said brake support structure so that said brake means is capable of being slidably moved along said brake support structure and rotated there about to enable the roll to be removed from said rod-like member and replaced with a new roll.

4. An apparatus for vertically dispensing a roll of paper towels and the like, the roll defining a hollow interior which is axially aligned about an axis of the roll, the roll also having two ends, one of which faces upwardly and one of which faces downwardly when the roll is installed on said apparatus, said apparatus comprising:

a base;

a first upright rod-like member for maintaining a roll installed thereon in an upright position, said first rod-like member having a proximal end and a distal end with said proximal end attached to said base; the roll being installed on said first rod-like member so that said first rod-like member is positioned within the hollow interior of the roll;

a second upright rod-like member having a proximal end and a distal end with said proximal end attached to said base, said second rod-like member being sufficiently spaced from said first rod-like member to permit the roll of paper towels to be installed on said first rod-like member; and gravity brake means having a first end defining a first bore which is sized and configured to slidably receive said first rod-like member to secure said brake means in a braking position, said brake means also having a second end defining a second bore, said second bore slidably receiving said second rod-like member so that said brake means is slidably engaged to and rotatable about said second rod-like member, said brake means being slidably engaged to and rotatable about said second rod-like member so that said brake means is capable of being slidably lifted off said distal end of said first rod-like member and rotated about said second rod-like member to enable the roll to be removed from said first rod-like member and replaced with a new roll, said brake means also defining an underside surface so that when said brake means is in the braking position, said underside surface frictionally engages the upwardly facing end of the roll under the force of gravity to stop the roll from rotating and unrolling after a paper towel has been torn from the roll.

5. An apparatus as claimed in claim 4 wherein said brake means is weighted to increase frictional engagement between the roll and said underside surface of said brake means.

6. An apparatus as claimed in claim 4 wherein said second rod-like member is taller than said first rod-like member.

7. An apparatus as claimed in claim 6 further comprising a cap attached to said distal end of said second rod-like member for preventing said brake means from being slidably removed from said second rod-like member.

8. An apparatus as claimed in claim 4 further comprising:

a lower centering bearing rotatably mounted about said proximal end of said first rod-like member against said base, said bearing being sized and configured to center a roll installed on said first rod-like member so that the roll is generally axially aligned with the lengthwise axis of said first rod-like member, said bearing being rotatable to reduce drag on the roll when it is desired to tear off a paper towel from said roll.

9. An apparatus as claimed in claim 8 further comprising stop means attached to said first rod-like member at a point on said first rod-like member adjacent said proximal end of said first rod-like member to prevent removal of said lower centering bearing from said first rod-like member.

10. An apparatus as recited in claim 9 wherein said stop means includes a pin attached to and projecting outwardly from said first rod-like member.

11. An apparatus as claimed in claim 4 further comprising:

an upper centering collar defining a center bore for slidably receiving said first rod-like member, said upper centering collar being rigidly attached to said underside of said brake means with said center bore being axially aligned with said first bore of said brake means, said upper centering collar also being sized and configured to project into the upwardly facing end of the hollow interior defined by the roll to center the roll so that the roll is generally axially aligned with the lengthwise axis of said first rod-like member.

12. An apparatus as claimed in claim 4 wherein said first and second rod-like members are rigidly attached to said base.

13. An apparatus as claimed in claim 4 wherein said underside surface of said brake means is roughened to enhance frictional engagement with a roll of paper towels.

14. An apparatus for vertically dispensing a roll of paper towels and the like, the roll defining a hollow interior which is axially aligned about an axis of the roll, the roll also having two ends, one of which faces upwardly and one of which faces downwardly when the roll is installed on said apparatus, said apparatus comprising:

a base;

a first upright, generally cylindrical shaped rod-like member for maintaining a roll installed thereon in an upright position, said first rod-like member having a proximal end rigidly attached to said base, the roll being installed on said first rod-like member so that said first rod-like member is positioned within the hollow interior of the roll;

a second upright, generally cylindrically shaped rod-like member having a proximal end and a distal end with said proximal end rigidly attached to said base, said second rod-like member also being generally parallel to said first rod-like member and spaced a distance therefrom to permit the roll of paper towels to be installed on said first rod-like member;

gravity brake means having a first end defining a first bore which is sized and configured to slidably receive said first rod-like member to secure said brake means in a breaking position, said break means also having a second end defining a second bore, said second bore slidably receiving said second rod-like member so that said brake means is slidably engaged to and rotatable about said second rod-like member, said brake means being slidably engaged to and rotatable about said second rod-like member so that said brake means is capable of being slidably lifted off said distal end of said first rod-like member and rotated about said second rod-like member to enable the roll to be removed from said first rod-like member and replaced with a new roll, said brake means also defining an underside surface so that when said brake means is in the braking position, said underside surface frictionally engages the upwardly facing end of the roll under the force of gravity to stop the roll from rotating and unrolling after a paper towel has been torn from the roll;

a lower centering bearing rotatably mounted about said proximal end of said first rod-like member against said base, said bearing being sized and configured to center a roll installed on said first rod-like member, said bearing being rotatable to reduce drag on the roll when it is desired to tear off a paper towel from said roll;

an upper centering collar defining a center bore for slidably receiving said first rod-like member, said upper centering collar being rigidly attached to said underside of said brake means with said center bore being axially aligned with said first bore, said upper centering collar being sized and configured to project into the upwardly facing end of the hollow interior defined by the roll to center the roll about said first rod-like member.

15. An apparatus as recited in claim 14 further comprising a cap attached to said distal end of said second rod-like member to prevent said brake means from being slidably removed from said second rod-like member.

16. An apparatus as claimed in claim 14 further comprising a pin attached to said first rod-like member, said pin projecting outwardly from said first rod-like member at a point on said rod-like member adjacent said proximal end of said first rod-like member, said pin preventing removal of said lower centering bearing from said first rod-like member.

17. An apparatus as claimed in claim 14 wherein said brake means is weighted to increase frictional engagement between the roll and said underside surface of said brake means.

* * * * *